United States Patent [19]

Tackett

[11] Patent Number: 4,671,589

[45] Date of Patent: Jun. 9, 1987

[54] CONNECTOR ASSEMBLY WITH TOLERANCE COMPENSATION

[75] Inventor: Timothy N. Tackett, Warren, Ohio

[73] Assignee: General Motors Corporation, Detroit, Mich.

[21] Appl. No.: 825,382

[22] Filed: Feb. 3, 1986

[51] Int. Cl.[4] ..... H01R 11/00

[52] U.S. Cl. ..... 439/592; 439/586

[58] Field of Search ..... 339/59 R, 59 L, 59 M, 339/61 R, 61 L, 61 M, 65, 94 L, 144 R, 144 T, 154 L, 176 L, 182 L, 191 M, 206 R, 206 P, 143 R

[56] References Cited

U.S. PATENT DOCUMENTS

| | | | |
|---|---|---|---|
| 3,206,715 | 9/1965 | Skony | 339/192 |
| 3,351,890 | 11/1967 | Wilkinson et al. | 339/143 R |
| 3,566,341 | 2/1971 | Skony | 339/192 |
| 4,176,903 | 12/1979 | Cairo et al. | 339/147 |
| 4,592,615 | 6/1986 | Durand | 339/59 L |

*Primary Examiner*—Gil Weidenfeld
*Assistant Examiner*—Paula A. Austin
*Attorney, Agent, or Firm*—Patrick M. Griffin

[57] ABSTRACT

A connector assembly includes a connector body with a flexible tolerance compensation member to assure that consistent electrical contact is made between an electrical terminal of the assembly and the cylindrical contact portion of a vehicle cigarette lighter regardles of tolerance variations in the diameter of the contact portion above a minimum diameter. The connector body and tolerance compensation member include partially cylindrical guide and registration surfaces respectively that together provide a guide means with an effective diameter less than, but close to, the minimum diameter of the contact portion. The electrical terminal terminal is joined to the connector body so as to move with it and thereby maintain a constant location relative to the registration surface. The effective diameter of the guide means assures that the registration surface will be always engaged and flexed away by the component contact portion regardless of its actual diameter, thereby assuring that the electrical terminal will make a consistent electrical contact therewith.

3 Claims, 4 Drawing Figures

CONNECTOR ASSEMBLY WITH TOLERANCE COMPENSATION

This invention relates to connector assemblies in general and specifically to a connector assembly that is adapted to receive a component so as to make consistent electrical contact with the component regardless of tolerance variations in the size of a contact portion of the component.

BACKGROUND OF THE INVENTION

Connector assemblies such as those used with automobile cigarette lighters typically include a connector body with a feed terminal and ground terminal, and a component, such as a cylindrical metal shell, that is received in the connector body. Generally, a central pin of the cigarette lighter shell makes electrical contact with the feed terminal. This central pin may be easily fitted between the legs of the feed terminal, which are spaced apart less than the diameter of the central pin, thus making reliable and consistent electrical contact. However, it is generally necessary that the ground terminal make electrical contact with a contact portion of the shell that has a larger, cylindrical outer surface. This electrical connection will generally be by an interference fit with the ground terminal. Tolerance variations in the manufacture of the shell may cause the diameter of this cylindrical surface to vary. If the ground terminal is conventionally joined to the connector body so as to occupy a static position, the amount of the interference, and the consistency of the electrical contact, may vary with these tolerance variations.

SUMMARY OF THE INVENTION

The subject invention provides a connector assembly that is adapted to receive a component that has a contact portion with a minimum size but with an actual size that may be larger due to tolerance variations. The connector assembly of the invention includes a connector body that has a guide means and a tolerance compensation member, and an electrical terminal joined to the connector body, all of which cooperate together to make a consistent electrical contact with the contact portion of the component regardless of tolerance variations.

The connector assembly of the invention has a connector body adapted to receive the substantially cylindrical metal shell of a cigarette lighter. The contact portion of the shell is also substantially cylindrical and has a minimum diameter, although its actual diameter may vary above that minimum diameter. The connector body is molded of flexible plastic and has a partially cylindrical guide surface and a tolerance compensation member. The tolerance compensation member is generally in the form of a tube of square cross section located on one side of the connector body. The tolerance compensation member has a slot therein, and a partially cylindrical registration surface opposed to the guide surface. The registration surface and the guide surface together define a cylindrical surface that has an effective diameter close to, but slightly smaller than, the minimum diameter of the cylindrical contact portion of the cigarette lighter shell. An electrical ground terminal is located inside the tolerance compensation member and has a tab that is closely slideably received within the slot. This accurately positions the ground terminal relative to the registration surface of the tolerance compensation member. The close fitting of the tab within the slot assures that should the tolerance compensation member move, the ground terminal will move with it and remain in the same location relative to the registration surface.

The structure just described cooperates to give a consistent electrical contact. As the shell is pushed into the connector body, the cylindrical contact portion moves into engagement with the cylindrical guide surface and with the registration surface of the connector body. Since the effective diameter of the cylindrical surface defined by the registration surface and guide surface is close to the minimum diameter of the contact portion, those surfaces cooperate to provide a guide means to direct the contact portion into the connector body along a defined path. Furthermore, since that effective diameter is smaller than the minimum diameter of the contact portion, it is assured that the registration surface will be flexed outwardly of the connector body. Therefore, the registration surface will remain in substantially the same location relative to the contact portion regardless whether its actual diameter is greater than the minimum diameter. Since the ground terminal is designed to move with the tolerance compensation member, it will also remain in the same location relative to registration surface as the tolerance compensation member moves. The net result is that the contact portion of the cigarette lighter shell will engage the ground terminal with substantially the same interference regardless of the actual diameter of the contact portion. Therefore, the electrical contact made will be uniform and consistent regardless of any tolerance variations in the diameter of the contact portion.

It is, therefore, a basic object of the invention to provide a connector assembly adapted to receive a component having a contact portion with a minimum size and to make consistent electrical contact with the contact portion as the component is received regardless of tolerance variations above the minimum size.

It is another object of the invention to provide such a connector assembly that has a connector body adapted to receive the component, a connector body that includes a guide means to direct the component contact portion into the connector body in a defined path as the component is so received, and with a flexible tolerance compensation member on the connector body that has a registration surface engageable by the component contact portion as the contact portion is so guided and movable by the component contact portion so that the registration surface is maintained in substantially the same location relative to the component contact portion regardless of the tolerance variations, and in which the connector assembly also includes an electrical terminal joined to the connector body so as to move with the tolerance compensation member and thereby be maintained in substantially the same location relative to the registration surface, so that the electrical terminal will be be engaged by the component contact portion with substantially the same interference as the component is so received to thereby make consistent electrical contact with the component contact portion regardless of tolerance variations of the component contact portion above the minimum size.

It is yet another object of the invention to provide a connector assembly of the type described in which the component has a substantially cylindrical contact portion with a minimum diameter, the connector body has a partially cylindrical guide surface, and the tolerance compensation member has a partially cylindrical registration surface, with the the connector body guide surface and the tolerance compensation member registration surface defining together a cylindrical surface with an effective diameter sufficiently close to the minimum diameter of the component contact portion so as to provide a guide means to direct the component contact portion into the connector body in a defined path as the component is received, with the effective diameter further being sufficiently smaller than the component contact portion minimum diameter so as to assure that the registration surface will be engaged by the contact portion as the component is so received, thereby assuring consistent electrical contact with the component contact portion regardless of tolerance variations of the component contact portion above the minimum diameter.

It is yet another object of the invention to provide a connector assembly of the type described in which the tolerance compensation member also has a slot defined therein, and in which the electrical terminal further has a tab closely slideably receivable within the slot so as to position the terminal relative to the registration surface and so as to assure that the terminal will move with the tolerance compensation member and thereby be maintained in substantially the same location relative to the registration surface, whereby the electrical terminal may be engaged by the component contact portion with substantially the same interference as the component is so received to thereby make consistent electrical contact with the component contact portion regardless of tolerance variations of the component contact portion above the minimum diameter.

BRIEF DESCRIPTION OF THE DRAWINGS

These and other objects and features of the invention will appear from the following written description and the drawings in which.

Figure 1:
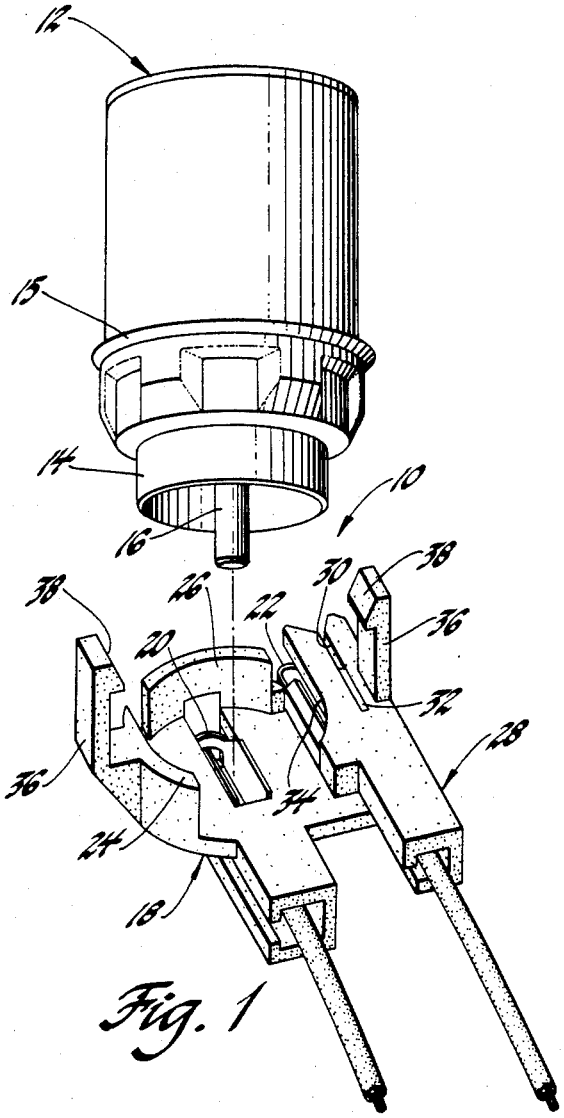
FIG. 1 is a perspective view of the connector assembly of the invention with the component to be received therein, a cigarette lighter shell, removed therefrom.

Referring first to FIG. 1, the preferred embodiment of the connector assembly of the invention is designated generally at 10. The connector assembly 10 is adapted to receive a component, which is, in the embodiment disclosed, the cylindrical metal shell of a vehicle cigarette lighter, designated generally at 12. The cigarette lighter shell 12 has a lower, substantially cylindrical contact portion designated at 14. Shell 12 also includes an outermost rim 15 and a central pin 16 extending from the bottom thereof. Contact portion 14 is subject to manufacturing tolerance variations in its size or diameter. That is to say, contact portion 14 will have a minimum size, or least diameter, but its actual diameter may vary above that minimum diameter. The connector assembly of the invention is adapted to receive shell 12, and to make consistent electrical contact with the contact portion 14, regardless of that tolerance variation.

Figure 4:
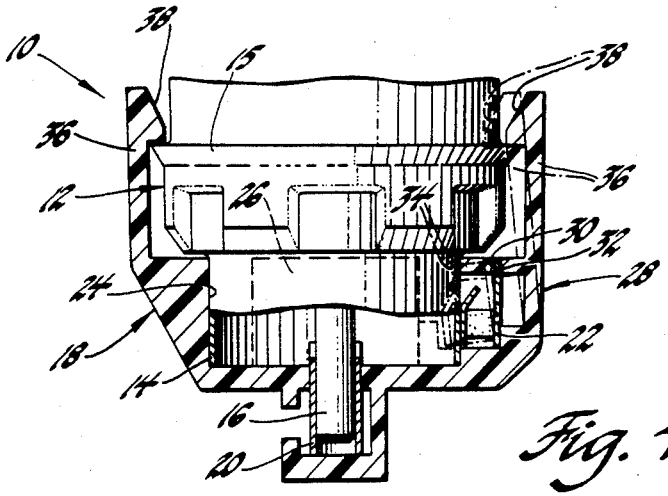
FIG. 4 is a sectional view of the connector assembly taken along the line 4—4 of FIG. 3 and showing the initial and final positions of the tolerance compensation member and the ground terminal in phantom and solid lines respectively.

Referring next to FIGS. 1 and 4, the connector assembly 10 includes a connector body designated generally at 18, a centrally located electrical feed terminal 20 and an electrical ground terminal 22. The connector body 18 is adapted to receive the shell 12, as will be described below. The feed terminal 20 receives the central pin 16, and although necessary to a complete electrical connection, does not constitute part of the subject invention. The ground terminal 22 makes electrical contact, by an interference fit described further below, with the outer surface of the contact portion 14 of shell 12. Before details of the electrical connection are described, the connector body 18 will be further described.

Figure 2:
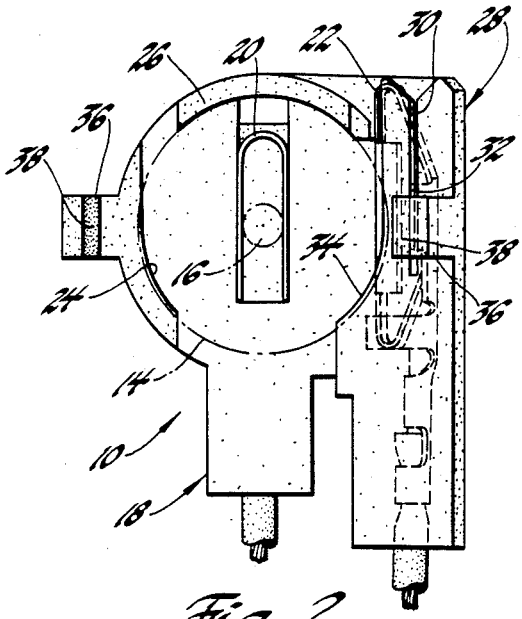
FIG. 2 is a top plan view of the connector assembly of the invention showing the received position of the cigarette lighter shell in phantom line and showing the initial, unflexed, position of both the tolerance compensation member and the electrical ground terminal.

Referring now to FIGS. 1, 2 and 4, the connector body 18 is molded of plastic or other suitable dielectric material that is also flexible. Connector body 18 includes a pair of upstanding, partially cylindrical walls 24 and 26. Walls 24 and 26 lie on a common circle as seen in FIG. 2, and are flexible relative to the connector body 18. Connector body 18 also includes a tolerance compensation member, designated generally at 28, which is generally opposed to the partially cylindrical wall 24. Tolerance compensation member 28 is generally in the form of a elongated hollow tube of square cross section. As may be best seen in FIG. 4, it is, in its free state, tilted inwardly slightly toward the center of connector body 18, as shown in dotted lines. Tolerance compensation member 28 has a slot 30 in the top thereof which closely slideably receives a tab 32 on ground terminal 22. The tolerance compensation member 28 also includes a partially cylindrical surface thereon, which may be termed a registration surface 34. Connector body 18 also includes a pair of upstanding flexible legs 36, one extending up from wall 24 and one extending up from the top of the tolerance compensation member 28. Each leg 36 includes an inwardly sloped lead-in surface 38 thereon, with the lead-in surfaces 38 being spaced apart a distance less than the diameter of rim 15 of shell 12. As may be best seen in FIG. 2, the inner surfaces of the walls 24 and 26 and the registration surface 34 cooperatively define a cylindrical surface or socket that has an effective diameter that is close to, but slightly smaller than, the minimum diameter of the contact portion 14. In FIG. 2, the diameter of the contact portion 14 is shown in phantom line for purposes of comparison. It may also be seen in FIGS. 1 and 2 that the close fitting of tab 32 within slot 30 serves to accurately determine the relative position of the inwardmost surface of feed terminal 22 relative to the registration surface 34, it being spaced inwardly therefrom. This relative location cooperates in the operation of the invention, described next.

Figure 3:
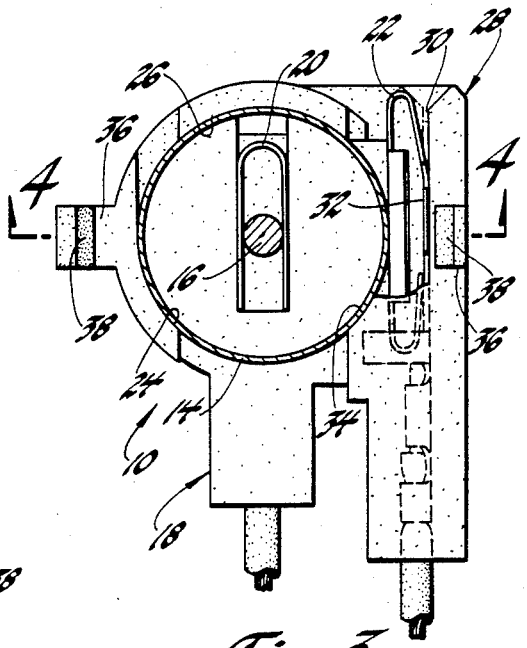
FIG. 3 is a view similar to FIG. 2, but showing the final, flexed, position of the tolerance compensation member and the ground terminal, and showing the cigarette lighter shell in cross section.

Referring next to FIGS. 1, 3 and 4, the shell 12 is received within the connector body 18 by pushing it down into it. It will be understood that rim 15 initially biases the lead-in surfaces 38 of legs 36 apart, flexing the legs 36 apart, and thereby also flexing wall 24 and the tolerance compensation member 28 apart. As shell 12 is pushed further down into connector body 18, the contact portion 14 moves into the socket that is defined by the two walls 24 and 26 and the registration surface 34. Since the effective diameter of that cylindrical socket or surface is close to the minimum diameter of the contact portion 14, a guide means is thereby provided to direct the contact portion 14 into the connector body in a controlled, defined path. When shell 12 has been pushed down as far as it will go, the ends of legs 36 snap over rim 15, thereby retaining shell 12, and pin 16 moves into feed terminal 20 to make electrical contact. It will be understood that while the flexible legs 36 and the lead-in surfaces 38 cooperate in the guiding and directing function, the surfaces of the walls 24 and 26 and the registration surface 34 could alone provide the guide means. The flexible legs 36 are not necessary to the operation of the invention in the broadest sense, but are advantageous in that they cooperate to both bias the wall 24 and the registration surface 34 apart, and to retain the shell 12 to the connector body 18.

Referring now to FIGS. 2–4, the making of electrical contact with the ground terminal 22 may be understood. Since the effective diameter of the socket defined by the walls 24, 26 and the registration surface 34 is smaller, although close to, than the minimum diameter of the contact portion 14, it is assured that the registration surface 34 will be engaged by the contact portion 14. Therefore, it is also assured that the tolerance compensation member 28 will be tilted or flexed outwardly, as is best illustrated in FIG. 4. Therefore, the registration surface 34 will maintain substantially the same location relative to the contact portion 14 regardless of any tolerance variations in the actual diameter of the contact portion 14 above the minimum diameter. In turn, the ground terminal 22 is joined to the tolerance compensation member 28 so that it maintains a constant location relative to the registration 34, moving with the tolerance compensation member 28 as it is flexed. Therefore, as the contact portion 14 of shell 12 moves in its defined path, it will engage the ground terminal 22 with an interference fit and compress the terminal 22 relative to the registration surface 34 by a constant, substantially invariant amount. Therefore, the electrical contact that is made with the ground terminal 22 will be consistent. This is best illustrated in FIGS. 2 and 3, FIG. 2 showing the unflexed position of the tolerance compensation 28 and FIG. 3 showing the final position.

Variations of the preferred embodiment are possible within the spirit of the invention. The invention could be used with a contact portion 14 of a component 12 that was some shape other than cylindrical, even rectangular, although a cylindrical shape is the most common and convenient to manufacture. As previously mentioned, the walls 24 and 26 and the registration surface 34 could alone serve as a guide means for the contact portion 14, and conceivably, with a tight enough frictional fit, also serve to alone retain the shell 12 to the connector body 18. However, the flexible legs 36 are an advantageous retention means, and also cooperate in the guiding function, as has already been described. Other means could be used to join the ground terminal 22 to the tolerance compensation member 28. However, the closely interfitting tab 32 and slot 30 is a convenient and practical means to both accurately locate the ground terminal 22 relative to the registration surface 34 and to assure that the ground terminal 22 will move with tolerance compensation member 28 as it flexes. Therefore, it will be understood that the invention is capable of being embodied in structures other than that disclosed, and is not intended to be so limited.

The embodiments of the invention in which an exclusive property or privilege is claimed are defined as follows:

1. A connector assembly adapted to receive a component having a contact portion with a minimum size and to make consistent electrical contact with said contact portion as said component is received regardless of tolerance variations above said minimum size, said assembly comprising in combination, a connector body adapted to receive said component, said connector body further including guide means to direct said component contact portion into said connector body in a defined path as said component is so received, a tolerance compensation member on said connector body having a registration surface that is engageable by said component contact portion as said contact portion is so guided, said tolerance compensation member further being flexible so as to allow said registration surface to move as it is engaged by said component contact portion, said tolerance compensation member thereby cooperating with said guide means to maintain said registration surface in substantially the same location relative to said component contact portion as said component is so received regardless of said tolerance variations, and, an electrical terminal joined to said connector body so as to move with said tolerance compensation member and thereby be maintained in substantially the same location relative to said registration surface, whereby said electrical terminal may be engaged by said component contact portion with substantially the same interference as said component is so received to thereby make consistent electrical contact with said component contact portion regardless of tolerance variations of said component contact portion above said minimum size.

2. A connector assembly adapted to receive a component having a substantially cylindrical contact portion with a minimum diameter and to make consistent electrical contact with said contact portion as said component is received regardless of tolerance variations above said minimum diameter, said assembly comprising in combination, a connector body adapted to receive said component, said connector body further including a partially cylindrical guide surface, a tolerance compensation member on said connector body having a partially cylindrical registration surface, said connector body guide surface and said tolerance compensation member registration surface defining together a cylindrical surface with an effective diameter sufficiently close to said minimum diameter of said component contact portion so as to provide a guide means to direct said component contact portion into said connector body in a defined path as said component is so received, said effective diameter further being sufficiently smaller than said component contact portion minimum diameter so as to assure that said registration surface will be engaged by said contact portion as said component is so received, said tolerance compensation member further being flexible so as to allow said registration surface to be moved by said contact portion and thereby remain in substantially the same location relative to said contact portion regardless of said tolerance variations, and, an electrical terminal joined to said connector body so as to move with said tolerance compensation member and thereby be maintained in substantially the same location relative to said registration surface, whereby said electrical terminal may be engaged by said component contact portion with substantially the same interference as said component is so received to thereby make consistent electrical contact with said component contact portion regardless of tolerance variations of said component contact portion above said minimum diameter.

3. A connector assembly adapted to receive a component having a substantially cylindrical contact portion with a minimum diameter and to make consistent electrical contact with said contact portion as said component is received regardless of tolerance variations above said minimum diameter, said assembly comprising in combination, a connector body adapted to receive said component, said connector body further including a partially cylindrical guide surface, a tolerance compensation member on said connector body having a partially cylindrical registration surface, said connector body guide surface and said tolerance compensation member registration surface defining together a cylindrical surface with an effective diameter sufficiently close to said minimum diameter of said component contact portion so as to provide a guide means to direct said component contact portion into said connector body in a defined path as said component is so received, said effective diameter further being sufficiently smaller than said component contact portion minimum diameter so as to assure that said registration surface will be engaged by said contact portion as said component is so received, said tolerance compensation member further being flexible so as to allow said registration surface to be moved by said contact portion and thereby remain in substantially the same location relative to said contact portion regardless of said tolerance variations, said tolerance compensation member further having a slot defined therein, and, an electrical terminal having a tab closely slideably receivable within said slot so as to position said terminal relative to said registration surface and so as to assure that said terminal will move with said tolerance compensation member and thereby be maintained in substantially the same location relative to said registration surface, whereby said electrical terminal may be engaged by said component contact portion with substantially the same interference as said component is so received to thereby make consistent electrical contact with said component contact portion regardless of tolerance variations of said component contact portion above said minimum diameter.

* * * * *